US007781975B2

(12) United States Patent
Ueno et al.

(10) Patent No.: US 7,781,975 B2
(45) Date of Patent: Aug. 24, 2010

(54) GAS DISCHARGE TUBE HAVING CATHODE COVER MADE OF CERAMICS

(75) Inventors: Kazuo Ueno, Hamamatsu (JP); Yoshinobu Ito, Hamamatsu (JP); Koji Matsushita, Hamamatsu (JP)

(73) Assignee: Hamamatsu Photonics K. K., Hamamatsu-shi, Shizuoka (JP)

( * ) Notice: Subject to any disclaimer, the term of this patent is extended or adjusted under 35 U.S.C. 154(b) by 519 days.

(21) Appl. No.: 11/660,961

(22) PCT Filed: Aug. 10, 2005

(86) PCT No.: PCT/JP2005/014674

§ 371 (c)(1),
(2), (4) Date: Feb. 23, 2007

(87) PCT Pub. No.: WO2006/022144

PCT Pub. Date: Mar. 2, 2006

(65) Prior Publication Data

US 2007/0257618 A1 Nov. 8, 2007

(30) Foreign Application Priority Data

Aug. 24, 2004 (JP) ..... 2004-244283

(51) Int. Cl.
*H01J 17/02* (2006.01)

(52) U.S. Cl. ..... 313/614; 313/243; 313/613

(58) Field of Classification Search ..... 313/112, 313/117, 243, 292, 581, 589, 590, 613, 614, 313/622

See application file for complete search history.

(56) References Cited

U.S. PATENT DOCUMENTS

| | | | | |
|---|---|---|---|---|
| 5,698,945 | A | 12/1997 | Ikedo et al. | |
| 2004/0046506 | A1 * | 3/2004 | Kawai et al. | 313/634 |

FOREIGN PATENT DOCUMENTS

| | | |
|---|---|---|
| JP | 48-024284 | 7/1971 |
| JP | 48-40990 | 12/1973 |
| JP | 4-255662 | 10/1992 |
| JP | 5-217550 | 8/1993 |
| JP | 7-288106 | 10/1995 |
| JP | 8-222185 | 8/1996 |
| JP | 8-222186 | 8/1996 |
| JP | 8-236081 | 9/1996 |

(Continued)

*Primary Examiner*—Bumsuk Won
(74) *Attorney, Agent, or Firm*—Drinker Biddle & Reath LLP

(57) ABSTRACT

A gas discharge tube 100 including a sealed container 1 in which a gas is sealed, an anode disposed within the sealed container, a cathode 7 which is spaced from the anode 4 in the sealed container 1 and generates discharge between the cathode 7 and the anode 4, a conductive part 6 restricting a discharge path, the conductive part 6 being disposed between the anode 4 and the cathode 7 and narrowing the discharge path, wherein by providing a cathode cover 8 which is made of ceramics, encloses the cathode 7, and has an opening 8*d* at least on an electron emission side, the cathode cover 8 increases the heat retaining effect of the cathode 7, makes it easy to keep the temperature of the cathode 7, and reduces power consumption.

6 Claims, 4 Drawing Sheets

FOREIGN PATENT DOCUMENTS

| | | |
|---|---|---|
| JP | 11-260316 | 9/1999 |
| JP | 2000-315417 | 11/2000 |
| JP | 2000-315418 | 11/2000 |
| JP | 2000-315419 | 11/2000 |
| JP | 2002-151008 | 5/2002 |

* cited by examiner

GAS DISCHARGE TUBE HAVING CATHODE COVER MADE OF CERAMICS

TECHNICAL FIELD

The present invention relates to a gas discharge tube, more specifically, to a gas discharge tube such as a deuterium lamp to be used as a light source of a spectroscope or chromatography, etc.

BACKGROUND ART

Conventionally, there is known a gas discharge tube including a sealed container in which a gas (deuterium gas) is sealed, an anode disposed within this sealed container, a cathode which is spaced from the anode in the sealed container and generates discharge between the cathode and the anode, and a conductive part restricting a discharge path which is disposed between the anode and the cathode to narrow the discharge path. In such a type of gas discharge tube, as described in Patent document 1 and 2 listed below, the cathode is formed by applying thermionic emission material onto a coil (filament coil) that functions as a heater. In the technique of the Patent document 1, the cathode is enclosed by a metal-made electrode enclosure having an opening for electron emission, and in the Patent document 2, it is enclosed by a metal-made front cover and a discharge rectifier plate having an electron discharge window.

Patent document 1: Japanese Unexamined Patent Publication No. H07-288106

Patent document 2: Japanese Unexamined Patent Publication No. 2002-151008

DISCLOSURE OF THE INVENTION

Problem to be Solved by the Invention

In the cathodes described in these documents, it is necessary to heat the coil by a power source to a predetermined temperature so that electrons are properly emitted from the cathode. However, in the Patent documents 1 and 2, the temperature of the cathode is lowered according to heat radiation, so that a power source with power consumption resistant to this heat radiation is necessary, so that the power source becomes comparatively large in size and the gas discharge tube including this power source cannot be downsized, and accordingly, an apparatus, for example, a spectroscope to which the gas discharge tube is applied cannot be downsized.

The present invention was made to solve this problem, and an object thereof is to provide a gas discharge tube which has a power source with reduced power consumption and can be downsized.

Means for Solving the Problem

A gas discharge tube according to the invention including a sealed container in which a gas is sealed, an anode disposed within this sealed container, a cathode which is spaced from the anode in the sealed container and generates discharge between the cathode and the anode, and a conductive part restricting a discharge path, the conductive part being disposed between the anode and the cathode and narrowing the discharge path formed between the anode and the cathode, wherein the gas discharge tube further includes a cathode cover made of ceramics which encloses the cathode and has an opening at least on an electron emission side.

According to this gas discharge tube, the cathode is enclosed by the cathode cover which is made of ceramics having excellent heat retaining property and has the opening at least on the electron emission side, so that the heat retaining effect of the cathode is increased by this cathode cover, it becomes easy to keep the temperature of the cathode, and the power consumption is reduced.

Herein, as the cathode cover, in detail, the cathode cover is constructed so that the above-described opening is formed into a slit shape and a ceramics-made slit plate is provided and integrated with the cathode cover. By making the whole of the cathode cover of ceramics and making the opening the necessary minimum, the heat retaining effect of the cathode is further increased, and power consumption is further reduced.

When the cathode cover is integrally made of ceramics so as to cover the cathode in a manner enabling the cathode to emit electrons and cover an assembly including the anode and the part restricting the discharge path in a manner enabling the assembly to discharge between the anode and the cathode, exposure more than necessary of the part restricting the discharge path is prevented and the member for increasing the discharge efficiency becomes unnecessary, and the number of parts is reduced.

When the part restricting the discharge path is sandwiched and fixed between the portion covering the assembly of the cathode cover and a plate fixing the part restricting the discharge path, the plate having an opening for passing-through of the discharge path and being made of ceramics, the part restricting the discharge path can be easily fixed by a reduced number of parts.

The gas discharge tube of the invention includes a sealed container in which a gas is sealed, an anode disposed within this sealed container, a cathode which is spaced from the anode in the sealed container and generates discharge between the cathode and the anode, and a conductive part restricting a discharge path, the conductive part being disposed between the anode and the cathode and narrowing the discharge path formed between the anode and the cathode, wherein the gas discharge tube includes a cathode cover which encloses the cathode and has an opening at least on an electron emission side, and a slit plate made of ceramics in which a slit-shaped opening is formed corresponding to an opening of the cathode.

According to this gas discharge tube, the cathode is enclosed by the cathode cover which has the slit-shaped opening provided at least on the electron emission side of the cathode and has the ceramics-made slit plate, so that the heat retaining effect of the cathode is increased by the cathode cover, the temperature of the cathode is easily kept and the power consumption is reduced.

EFFECT OF THE INVENTION

According to this gas discharge tube, lower power consumption of a power source can be realized, and the gas discharge tube including the power source can be downsized.

DESCRIPTION OF THE REFERENCE NUMERALS

Figure 1:
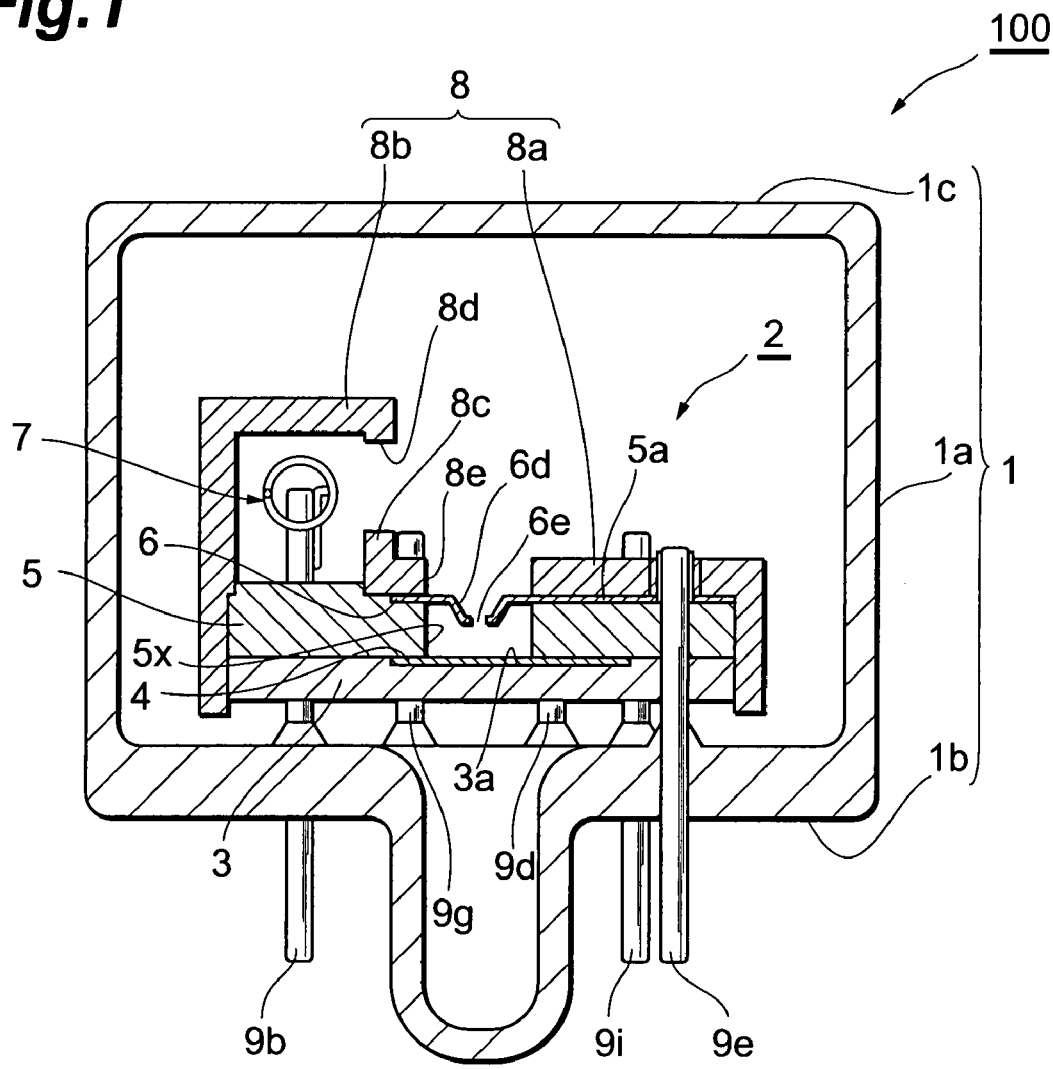
FIG. 1 is a longitudinal sectional view showing a gas discharge tube according to a first embodiment of the invention.

1: sealed container
4: anode
5: plate fixing a part restricting a discharge path
5*x*: opening of plate fixing a part restricting a discharge path
6: part restricting a discharge path
6*e*: opening narrowing a discharge path
7: cathode
8, 18, 28: cathode cover
8*a*: anode side cover portion (portion to cover assembly)
8*b*, 28*b*: cathode side cover portion
8*c*: slit plate
8*d*: slit
8*e*: opening of anode side cover portion
100: gas discharge tube

BEST MODES FOR CARRYING OUT THE INVENTION

Hereinafter, a preferred embodiment of the invention will be described in detail with reference to the accompanying drawings. For easy understanding of the description, the same reference numbers are attached wherever possible to the same components in the drawings, and overlapping description is omitted.

Figure 2:
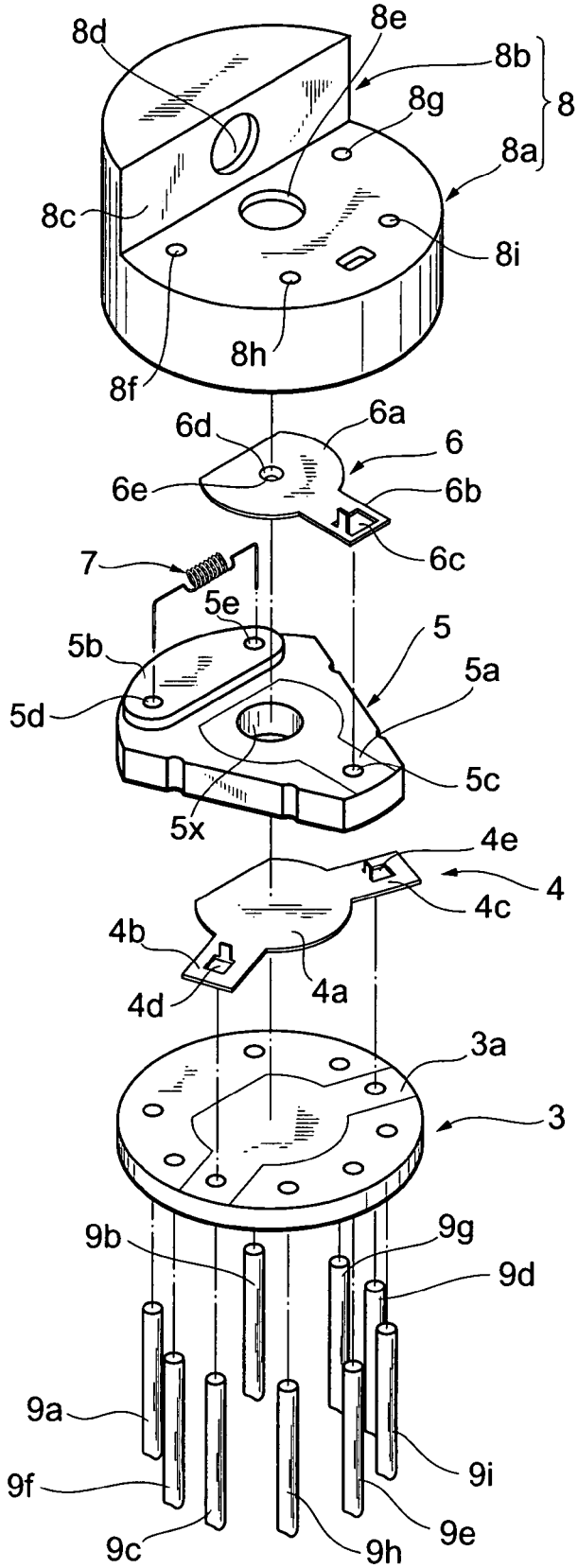
FIG. 2 is an exploded perspective view of a light emitting part assembly in FIG. 1.

FIG. 1 is a longitudinal sectional view showing a gas discharge tube according to an embodiment of the invention, and FIG. 2 is an exploded perspective view of a light emitting part assembly in FIG. 1. The gas discharge tube 100 is a so-called head-on type deuterium lamp to be used as a light source of a spectroscope or chromatography, etc. This gas discharge tube 100 includes, as shown in FIG. 1, a glass-made sealed container 1 and a light emitting part assembly 2 housed in this sealed container 1.

The sealed container 1 includes a cylindrical side tube portion 1*a*, a stem portion 1*b* which seals a lower end side of this side tube portion 1*a*, and a light exit window 1*c* which seals an upper end side, and in this sealed container 1, a deuterium gas is sealed by a pressure of several hundreds Pa. In the stem portion 1*b*, a plurality (nine in this embodiment) of openings are formed along a predetermined circumference, and conductive stem pins 9*a* and 9*b* through 9*i* (see FIG. 2) are inserted into the respective openings and sealed and fixed.

The light emitting part assembly 2 to be housed in the sealed container 1 is for generating an ultraviolet ray, and includes, as shown in FIG. 1 and FIG. 2, in order from the lower side, a base 3, an anode 4, a plate 5 fixing a part restricting a discharge path, a part 6 restricting the discharge path, and a cathode 7, and has a cathode cover 8 covering these.

The base 3 is formed into a disk shape from electrical insulating ceramics as shown in FIG. 2. In this base 3, a plurality of openings are formed along a peripheral edge, and stem pins 9*a* through 9*i* are inserted into the respective openings. In the upper surface of this base 3, a shallow concave portion 3*a* having a shape corresponding to the shape of the anode 4 so as to accommodate the anode 4 is formed.

The anode 4 is formed of a conductive thin plate, and includes a main body portion 4*a* in a substantially disk shape and a pair of extending portions 4*b* and 4*c* extending horizontally in radial directions from two points on the peripheral edge of the main body portion 4*a*, and is accommodated in the concave portion 3*a* of the base 3 as shown in FIG. 1 so that an upper surface thereof becomes flush with the upper surface of the base 3. This anode 4 has openings 4*d* and 4*e* in the extending portions 4*b* and 4*c* as shown in FIG. 2, and in these openings 4*d* and 4*e*, stem pins 9*c* and 9*d* are inserted and the anode 4 is electrically connected to tip ends of the stem pins.

The plate fixing the part 5 restricting the discharge path is made of ceramics and formed in a substantially fan shape, and is placed so as to overlap substantially central portions of the base 3 and the anode 4. The plate 5 fixing the part restricting the discharge path has, substantially at its center, an opening 5*x* for exposing the main body portion 4*a* of the anode 4 provided through which a discharge path formed between the anode 4 and the cathode 7 passes. In the upper surface on a narrower width side (right side of the drawing) including the opening 5*x* of the plate 5 fixing the part restricting the discharge path, a shallow concave portion 5*a* having a shape corresponding to the shape of the part 6 restricting the discharge path so as to accommodate the part 6 restricting the discharge path is formed, and on the upper surface on the wider width side (left side of the drawing), a convex portion 5*b* on which the cathode 7 is stood is provided. At a position on the narrower width side of the concave portion 5*a* of the plate 5 fixing the part restricting the discharge path, an opening 5*c* is provided, and in this opening 5*c*, a stem pin 9*e* is inserted. In the convex portion 5*b* of the plate 5 fixing the part restricting the discharge path, a pair of openings 5*d* and 5*e* are provided, and in these openings 5*d* and 5*e*, stem pins 9*a* and 9*b* are inserted, respectively.

The part 6 restricting the discharge path is formed of a conductive thin plate including a main body portion 6*a* in a substantially disk shape and an extending portion 6*b* extending horizontally in a radial direction from the peripheral edge of the main body portion 6*a*, and as shown in FIG. 1, accommodated in the concave portion 5*a* of the plate 5 fixing the part restricting the discharge path so that an upper surface thereof becomes flush with the upper surface of the plate 5 fixing the part restricting the discharge path. This part 6 restricting the discharge path has an opening 6*c* in its extending portion 6*b* as shown in FIG. 2, and in this opening 6*c*, a stem pin 9*e* is inserted and the part 6 restricting the discharge path is electrically connected to a tip end of the stem pin.

In the part 6 restricting the discharge path, as shown in FIG. 1 and FIG. 2, at a position coaxial with the opening 5*x* of the plate 5 fixing the part restricting the discharge path, a concave portion 6*d* for arc ball forming is provided. This concave portion 6*d* is formed in a cup shape which is expanded toward the light exit window 1*c* so as to accommodate an arc ball formed by discharge and efficiently extract light. In the bottom surface of the concave portion 6*d* of the part 6 restricting the discharge path, an opening 6*e* narrowing the discharge path with a small diameter of approximately 0.5 mm is formed, and thereby, it becomes possible to form an arc ball in a flat ball shape in the concave portion 6*d*.

The cathode 7 is formed by applying thermionic emission material such as barium oxide, etc., onto a coil (filament coil) that functions as a heater. In this cathode 7, as shown in FIG. 2, both ends of the coil are stood by being inserted into the openings 5*d* and 5*e* of the convex portion 5*b* of the plate 5 fixing the part restricting the discharge path, and are electrically connected to the stem pins 9*a* and 9*b* inserted into the openings 5*d* and 5*e*.

The cathode cover 8 has, as shown in FIG. 1 and FIG. 2, a cylindrical shape, and has an anode side cover portion 8*a* which covers an assembly including the anode 4 and the part 6 restricting the discharge path, etc., and a cathode side cover portion 8*b* which is continuously installed on an upper portion on the cathode 7 side of the anode side cover portion 8 so as to communicate with a space inside the anode side cover portion 8*a* and projects upward, and forms a smaller portion of a cylindrical shape coaxial with and the same in diameter as the anode side cover portion 8*a* when the cylindrical shape is cut vertically along an axis line direction at a position that does not include the axis line, and covers the cathode 7, and these anode side cover portion 8*a* and the cathode side cover portion 8*b* are integrally molded from ceramics.

The cathode side cover portion 8*b* of the cathode cover 8 has a slit 8*d* for emission of electrons as an opening in the slit plate 8*c* on an axis center side (electron emission side of the cathode 7) of the opening 6*e* narrowing the discharge path, and on the other hand, the anode side cover portion 8*a* has an opening 8*e* through which the discharge path passes at a position coaxial with the opening 5*x* of the plate 5 fixing the part restricting the discharge path and the opening 6*e* narrowing the discharge path of the part 6 restricting the discharge path. This opening 8*e* is set to a size which prevents exposure more than necessary of the part 6 restricting the discharge path to increase the discharge efficiency. The anode side cover portion 8*a* has, as shown in FIG. 2, openings 8*f* through 81, and in these openings 8*f* through 81, remaining stem pins 9*f* through 9*i* which are positioned outside the anode 4 and the plate 5 fixing the part restricting the discharge path and extending upward are inserted, respectively, and the respective tip ends thereof are joined and fixed. Thereby, the cathode cover 8 is fixed, and between the cathode cover 8 and the base 3, the anode 4, the plate 5 fixing the part restricting the discharge path, and the part 6 restricting the discharge path are overlapped, sandwiched, and fixed.

Next, operations of the gas discharge tube 100 thus constructed will be described. First, before discharge, a power of approximately 10 W is supplied to the cathode 7 for approximately 20 seconds via the stem pins 9*a* and 9*b* from an external power source for cathode (not shown) to preheat the coil forming the cathode 7. Then, between the cathode 7 and the anode 4, a voltage of approximately 160V is applied via the stem pins 9*c* and 9*d* from an external power source for main discharge (not shown) to make preparations for arc discharge.

Thereafter, from an external power source for trigger (not shown), a predetermined voltage, for example, a voltage of approximately 350V is applied between the part 6 restricting the discharge path and the anode 4 via the stem pins 9*e*, 9*c*, and 9*d*. Then, discharge is successively generated between the cathode 7 and the part 6 restricting the discharge path and between the cathode 7 and the anode 4, and starting discharge is generated between the cathode 7 and the anode 4. When starting discharge is generated, arc discharge (main discharge) is maintained between the cathode 7 and the anode 4, and an arc ball is generated in the concave portion 6*d* of the part 6 restricting the discharge path. An ultraviolet ray to be extracted from this arc ball is emitted as light with very high luminance to the outside through the light exit window 1*c*. When discharging, spatter and evaporated products from the cathode 7 are prevented by the cathode side cover portion 8*b* from adhering to the light exit window 1*c*.

In this gas discharge tube 100, the cathode 7 is made of ceramics which is excellent in heat retaining property, and is enclosed by the cathode side cover portion 8*b* of the cathode cover 8 in which only the slit 8*d* for electron emission is formed as the necessary minimum opening, so that the heat retaining effect of the cathode 7 is remarkably improved by the cathode side cover portion 8*b*. Therefore, it becomes easy to keep the temperature of the cathode 7, and the power consumption is reduced, and as a result, the gas discharge tube 100 including the power source is downsized.

In addition, the cathode cover 8 is integrally made of ceramics so that the cathode side cover portion 8*b* thereof covers the cathode 7 in a manner enabling the cathode to emit electrons and the anode side cover portion 8*a* covers the assembly including the anode 4 and the part 6 restricting the discharge path in a manner enabling these to discharge, so that exposure more than necessary of the part 6 restricting the discharge path is prevented, and a member for increasing the discharge efficiency (separate member corresponding to the upper portion of the anode side cover portion 8*a* of this embodiment) becomes unnecessary. Therefore, the number of parts and the cost are reduced.

The part 6 restricting the discharge path is sandwiched and fixed between an upper wall portion of the anode side cover portion 8*a* covering the assembly of the cathode cover 8 and the plate 5 fixing the part restricting the discharge path having the opening 5*x* which the discharge path passes through, so that the part 6 restricting the discharge path can be easily fixed by the reduced number of parts, and this results in further reduction in cost.

Figure 3:
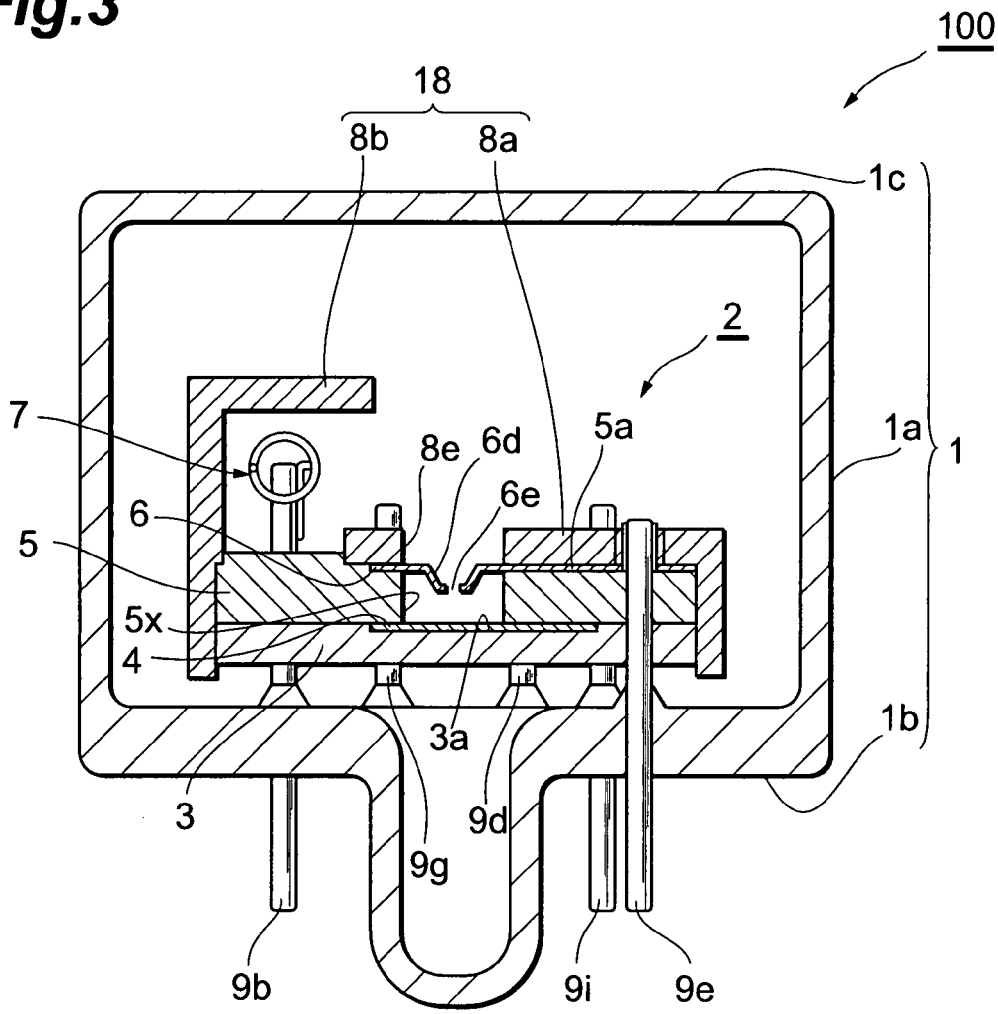
FIG. 3 is a longitudinal sectional view showing a gas discharge tube according to another embodiment of the invention.

The invention is described in detail above based on the embodiment, however, the invention is not limited to the embodiment, and for example, in the above-described embodiment, the opening of the cathode side cover portion 8*b* of the cathode cover 8 is the necessary minimum and a slit 8*d* as an opening is provided only in the slide plate 8*c* forming the cathode side cover portion 8*b*, however, it is also possible that, although the heat retaining effect is slightly lower than in the above-described embodiment, other openings (openings which are not for electron emission) are provided in the upper wall portion of the cathode side cover portion 8*b*, a portion opposite the slit 8*d* of the peripheral wall portion, and a side portion of the peripheral wall portion, etc. It is also allowed that the cathode side cover portion 8*b* has no slit plate 8*c* as in the case of the cathode cover 18 shown in FIG. 3, and the portion of the slit plate 8*c* is fully opened.

Figure 4:
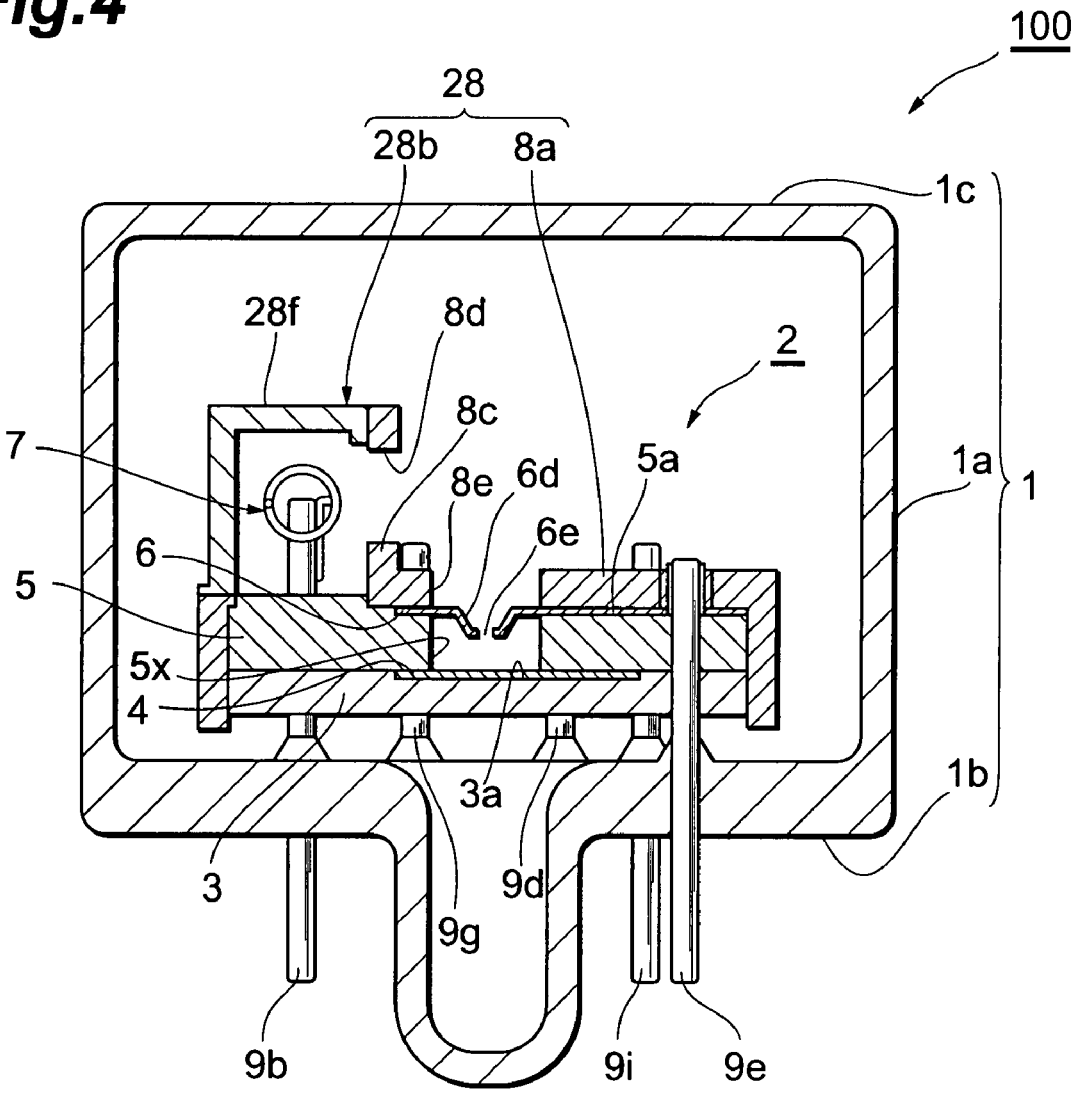
FIG. 4 is a longitudinal sectional view showing a gas discharge tube according to still another embodiment of the invention.

Furthermore, it is also possible that, as shown in FIG. 4, a cathode cover 28 which encloses the cathode 7 and has an opening at least on an electron emission side (other openings may be provided other than the electron emission side), and the cathode side cover portion 28*b* of the cathode cover 28 has, on an electron emission side of the cathode 7, a slit plate 8*c* which has a slit 8*d* for emission of electrons provided as an opening and is made of ceramics, and a portion other than this slit plate is formed as a separate member 28*f* made of, for example, a metal and joined to the slit plate 8*c*. Namely, only the slit plate 8*c* of the cathode side cover portion 28*b* may be made of ceramics. Even with this construction, a heat retaining effect higher than in the conventional techniques is obtained although the effect is lower than in the above-described embodiment.

INDUSTRIAL APPLICABILITY

A gas discharge tube according to the invention is preferably applicable as a construction of a deuterium lamp to be used as a light source of a spectroscope or chromatography, etc.

The invention claimed is:

1. A gas discharge tube comprising:

a sealed container in which a gas is sealed;

an anode disposed within the sealed container;

a cathode which is spaced from the anode in the sealed container and generates discharge between the cathode and the anode; and a conductive part restricting a discharge path, the conductive part being disposed between the anode and the cathode and narrowing the discharge path formed between the anode and the cathode;

wherein the gas discharge tube further comprises a cathode cover made of ceramics having a cathode side cover portion which covers the cathode in a manner enabling the cathode to emit electrons, and an anode side cover portion which covers an assembly including the anode and the part restricting the discharge path in a manner enabling the assembly to discharge between the anode and the cathode, and said anode side cover portion has a flat upper portion wall having an opening and said upper portion wall is fixed to the assembly, wherein the gas discharge tube further comprises a base holding the anode, and a plate fixing the part restricting the discharge path, the plate being placed on the base, wherein the part restricting the discharge path is mounted on a cathode side face of the plate and is fixed and pressed by the back side of the flat upper portion wall of the cathode cover from an upper side of the part restricting the discharge path, and wherein the cathode cover is configured to surround both side walls of the plate and the base.

2. The gas discharge tube according to claim 1, wherein the opening of the cathode cover is formed into a slit shape, and the gas discharge tube further comprises a slit plate made of ceramics integrated with the cathode cover.

3. The gas discharge tube according to claim 1, wherein the cathode cover is integrally made of ceramics.

4. The gas discharge tube according to claim 3, wherein the part restricting the discharge path is sandwiched and fixed between a portion covering the assembly of the cathode cover and a plate fixing the part restricting the discharge path, the plate having an opening for passing-through of the discharge path and being made of ceramics.

5. The gas discharge tube according to claim 3, wherein said anode side cover portion is fixed to the assembly to cover the anode with said flat upper portion wall.

6. A gas discharge tube comprising:

a sealed container in which a gas is sealed;

an anode disposed within the sealed container;

a cathode which is spaced from the anode in the sealed container and generates discharge between the cathode and the anode; and a conductive part restricting a discharge path, the conductive part being disposed between the anode and the cathode and narrowing the discharge path formed between the anode and the cathode;

wherein the gas discharge tube further comprises:

a cathode cover having a cathode side cover portion which covers the cathode in a manner enabling the cathode to emit electrons, and an anode side cover portion which covers an assembly including the anode and the part restricting the discharge path in a manner enabling the assembly to discharge between the anode and the cathode, and said anode side cover portion has a flat upper portion wall having an opening and said upper portion wall is fixed to the assembly; and a slit plate made of ceramics in which a slit-shaped opening is formed corresponding to an opening of the cathode cover, wherein the gas discharge tube further comprises a base holding the anode, and a plate fixing the part restricting the discharge path, the plate being placed on the base, wherein the part restricting the discharge path is mounted on a cathode side face of the plate and is fixed and pressed by the back side of the flat upper portion wall of the cathode cover from an upper side of the part restricting the discharge path, and wherein the cathode cover is configured to surround both side walls of the plate and the base.

* * * * *